US006367155B2

(12) United States Patent
Homann

(10) Patent No.: US 6,367,155 B2
(45) **Date of Patent: *Apr. 9, 2002**

(54) HEATABLE CUTTING INSTRUMENT, SPECIALLY SCISSORS, KNIFE, CLIPPERS OR THE LIKE

(76) Inventor: Steffen Homann, Auwaldstr. 1, 79110 Freiburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,720

(22) PCT Filed: Oct. 14, 1997

(86) PCT No.: PCT/DE97/02345

§ 371 Date: Apr. 16, 1999

§ 102(e) Date: Apr. 16, 1999

(87) PCT Pub. No.: WO98/16355

PCT Pub. Date: Apr. 23, 1998

(30) Foreign Application Priority Data

| | | |
|---|---|---|
| Oct. 16, 1996 | (DE) | 296 18 309 U |
| Oct. 16, 1996 | (DE) | 296 18 310 U |
| Dec. 20, 1996 | (DE) | 296 22 126 U |

(51) Int. Cl.[7] ..... B26B 13/24; B26B 13/04

(52) U.S. Cl. ..... 30/140; 30/254; 30/260; 219/229

(58) Field of Search ..... 30/140, 254, 260, 30/266, 267, 341, 342; 606/28; 219/229, 233

(56) References Cited

U.S. PATENT DOCUMENTS

| | | | | | |
|---|---|---|---|---|---|
| 1,083,386 | A | * | 1/1914 | Chapman | 30/140 |
| 1,633,441 | A | * | 6/1927 | Firth | 30/267 |
| 2,863,036 | A | * | 12/1958 | Mitchell et al. | 30/140 |
| 2,866,068 | A | | 12/1958 | Bernstein et al. | |
| 3,024,342 | A | * | 3/1962 | Birnbach et al. | 30/140 |
| 4,193,189 | A | * | 3/1980 | Marin | 30/260 |
| 4,198,957 | A | | 4/1980 | Cage et al. | |
| 4,207,896 | A | * | 6/1980 | Shaw | 30/140 |
| 4,485,810 | A | | 12/1984 | Beard | |
| 5,046,251 | A | | 9/1991 | Scott | |
| 5,309,640 | A | * | 5/1994 | Caron | 30/140 |
| 5,408,574 | A | * | 4/1995 | Deevi et al. | 392/404 |
| 5,440,813 | A | * | 8/1995 | Roskam | 30/267 |
| 5,743,017 | A | * | 4/1998 | Dreher et al. | 30/140 |

FOREIGN PATENT DOCUMENTS

| | | |
|---|---|---|
| DE | 2 236 099 | 1/1974 |
| DE | 297 02 608 | 5/1997 |

* cited by examiner

*Primary Examiner*—Hwei-Siu Payer
(74) *Attorney, Agent, or Firm*—Gudrun E. Huckett

(57) ABSTRACT

A heatable cutting device has a plastic base body having a recess on one side thereof. A cutting blade, made of metal or ceramic, is inserted into and fixedly connected to the recess. An electric heating element for heating the cutting blade is provided. The electrical heating element is fixedly and permanently connected to a side of the cutting blade facing the base body. The electrical heating element is attached to the cutting blade by printing, sintering or gluing. An electric connection for connecting the cutting device to an electric voltage supply device for operating the electrical heating element is provided. A temperature sensor is connected to an upper side of the cutting blade in the area of the cutting blade that is heated by the heating element.

12 Claims, 2 Drawing Sheets

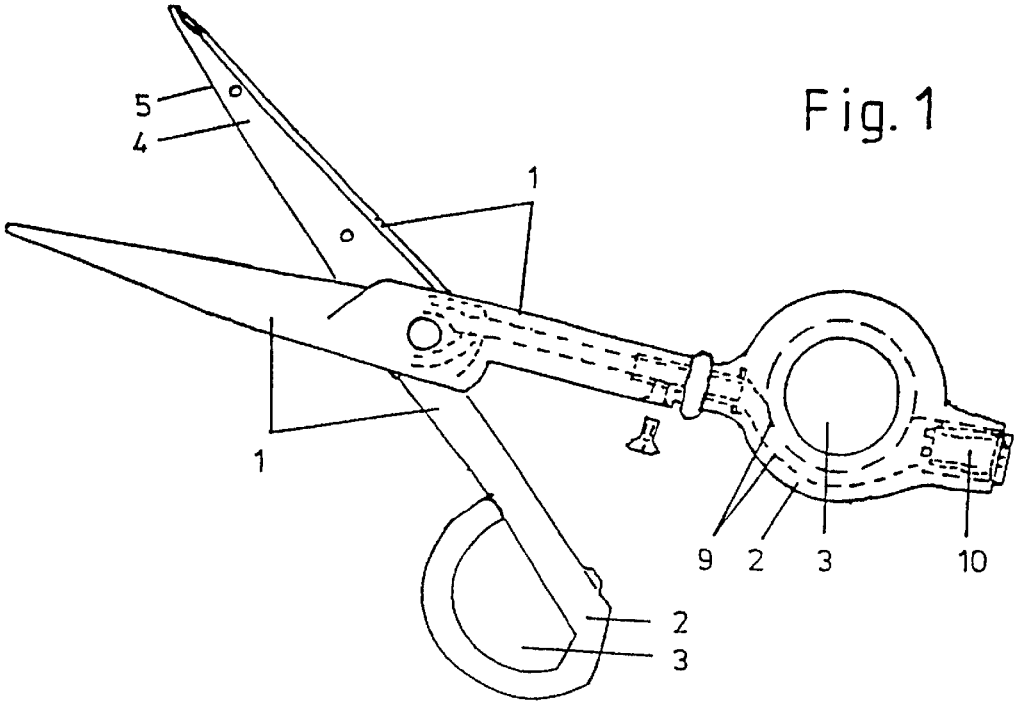
Fig. 1
Fig. 2
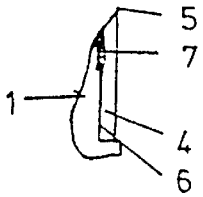
Fig. 3
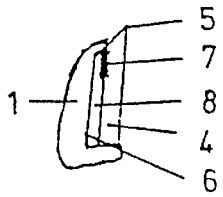
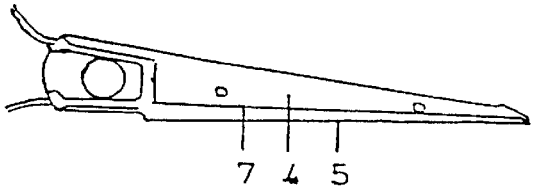
Fig. 4
Fig. 5
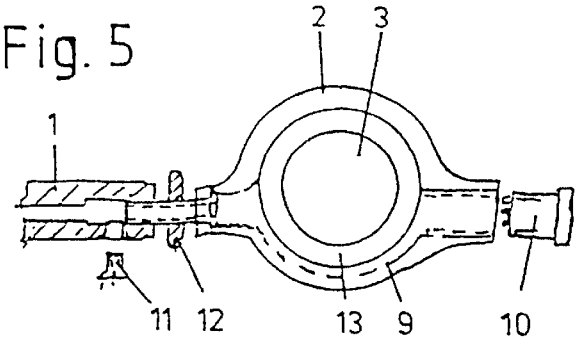

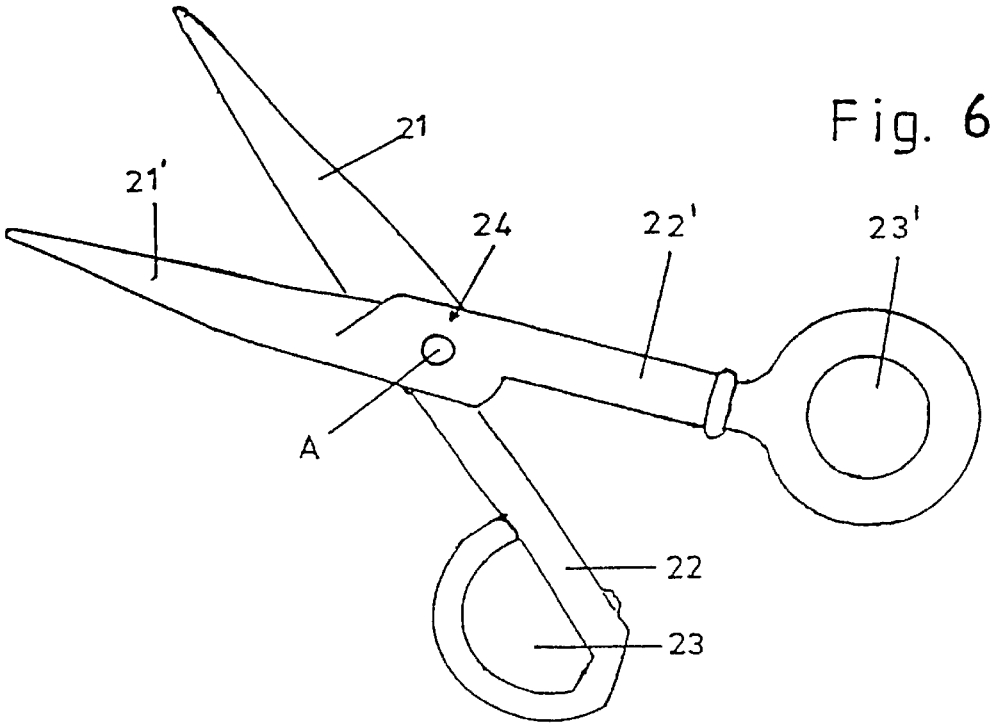
Fig. 6
Fig. 7
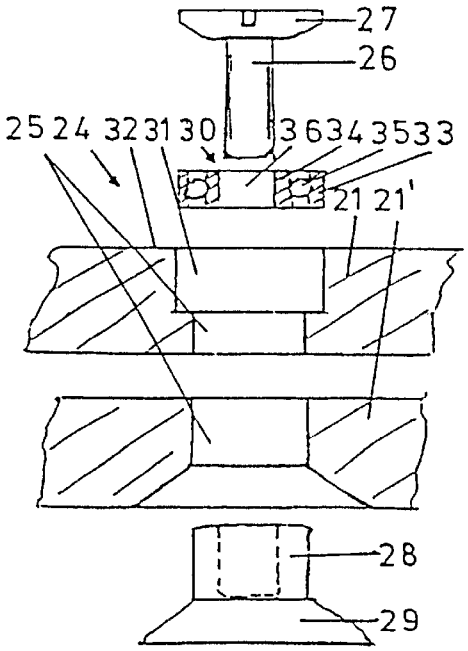
Fig. 8
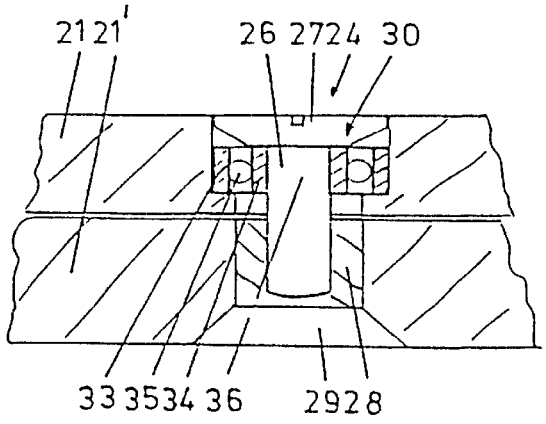

HEATABLE CUTTING INSTRUMENT, SPECIALLY SCISSORS, KNIFE, CLIPPERS OR THE LIKE

BACKGROUND OF THE INVENTION

The invention relates to a heatable cutting device, in particular, scissors, a knife, a hair-cutting apparatus or the like, with a cutting blade with an electric heating element for the heating process, and with an electric connection for operating the electric heating element by means of an electric voltage supply device.

Heatable cutting devices, in particular, heatable scissors for cutting hair have the advantage that the hair is cauterized by the hot cutting blades during cutting. This means that the hair ends lightly melt. The hair ends, therefore, are practically sealed and this counteracts spit ends.

A heatable cutting device in the form of heatable scissors of the aforementioned kind is known from WO 92/00688. The basic idea is to arrange a separate cutting element, made of metal and having a front cutting edge, to a blade holder defining a base body. For this purpose, the blade holder is provided with a recess into which the cutting element is inserted and secured by screws tot he blade holder. A separate heating foil is provided between the blade holder and the cutting element. The heating foil is supplied with current by an electric voltage supply device. The resistor element heats up the cutting element. The disadvantage of these known heatable scissors lies in the arrangement of the heating element in the form of a separate heating foil which has to be arranged between the blade holder and the actual cutting element. It is a disadvantage that moisture can very easily penetrate which can lead to destruction of the heating foil. Also the assembly of the heatable scissors is cumbersome.

Another type of heatable scissors is disclosed in DE-U-295 06 308. Here, the cutting blade is protected at its exterior side by a plastic cover. Between this plastic cover and the actual cutting blade, a heating foil is arranged which is also a separate member. The great disadvantage of this known heatable scissors is that moisture can very easily penetrate into the space between the cutting blade and the plastic cover, and, sooner or later, this will lead to destruction of the heating foil. Accordingly, these heatable scissors are associated with a high failure rate.

Another problem with all known heatable scissors is that the cables for electrically connecting the scissors to the electrical voltage supply frequently break. This means that the scissors have to be entirely disassembled for their repair in order to insert the cable. This is obviously cumbersome and costly.

The scissors may be any kind of scissors, for example, hairdresser's scissors, tailor's scissors, household scissors, poultry scissors, paper scissors, a hedge-trimmer etc. Such scissors, in general, have two cutting blades which are provided at the rear end with an actuating grip with openings for the fingers. In the transition area between the cutting blades and the actuating grips, the cutting blades are attached so as to be rotatable about a pivot axis relative to one another. This pivoting structure is formed by a screw which serves as a pivot axis. The problem with such scissors is that the pivoting structure has a relatively high frictional resistance so that the scissors are hard to actuate. This is particularly disadvantageous where the scissors are used for delicate and accurate cutting as, for example, at a hairdresser's, since scissors that are easily to actuate are required here.

It is an object of the invention to create a heatable cutting device with an improved design of the electric heating element and an improved design for handling.

SUMMARY OF THE INVENTION

As a technical solution, the invention suggests that the electric heating elements are permanently and fixedly attached to the cutting blade.

The advantage of an accordingly designed heatable cutting device is that the electric heating element is integrated into the cutting blade by an undetachable, permanent, and fixed arrangement so that an overall compact unit of cutting blade/heating element is created. Because of the fixed attachment of the heating element at the cutting blade, the heating element is essentially encapsulated, and, in comparison to known heating foil arrangements, it is less accessible to penetrating moisture and, thus, less likely to corrode. The great advantage of the inventive heatable cutting device lies in its high operational reliability with a long service life without operational failure. The voltage supply of the electric heating resistance is provided by a suitable electric control device. In order for the cutting blade to have the desired temperature, a temperature sensor for an exact temperature measurement is advantageously also provided in the heating area. Just like the heating element, the temperature sensor can also be fixedly attached to the cutting blade. Alternatively, it is also conceivable that the temperature sensor is positioned separately on the cutting blade. This temperature sensor is also connected to the control device.

A preferred embodiment suggests that the electric heating element is being printed, sintered, or glued onto the cutting blade. Other application possibilities are conceivable. Especially, printing represents the preferred attachment of the electric heating element to the cuffing blade. In this case, no heating foil is used. Instead, the heating element is applied to the cutting blade by thick layer technology. In particular, the electric heating element is being applied by screen-printing. This means that a current-conducting paste is printed on, i.e., is applied and subsequently fired Such a heat conductor can have a thickness of 4 micrometers. This is sufficient to bring the cutting blade to the desired temperature.

A further development of this design suggests that the electric heating element is formed as a line along the cutting edge of the cutting blade. The heating element is, thus, embodied as a thin line extending along the cutting edge at a spacing and parallel thereto.

Advantageously, the cutting blade is made of metal or ceramic. Particularly a cutting blade made of ceramic distinguishes itself by a long service life with respect to its sharpness.

A further embodiment of the inventive cuffing device suggests that the cutting blade is supplied with electric voltage. In this event, the cutting blade is made of an electrically conducting material, namely, metal. However, it is equally conceivable to provide a ceramic cutting blade with a suitable metal layer which has the necessary electrical properties. While the cutting blade is supplied with electric voltage, an electrical stimulation of the scalp is possible during the hair cutting process. All that is necessary is to connect the body to the other pole of the current supply so that corresponding current runs through the hair.

A preferred embodiment suggests that the cutting blade is arranged at a base body as a separate member. The advantage of this is that the heating element can be attached to the cutting blade in a simple manner. The cutting blade being prepared in this manner can then be attached to the actual base body of the cutting device, e.g., glued, riveted or bolted to it. Preferably, the base body is provided with a corresponding recess into which the cutting blade can be inserted.

The base body can be made of plastic or ceramic. Plastic is the preferred material because a plastic base body can be manufactured in a simple injection-molding procedure.

Alternatively, it is also conceivable that the base body is made of metal. In this event, conventional metal scissors can be used. The only requirement for inserting the cutting blade in the base body is to provide a corresponding recess in the cutting blade area into which the separate cutting blade with the integrated heating element can be inserted and attached to.

Preferably, an insulating member is arranged between the base body and the cutting blade. This insulating member serves as a heat insulation as well as an electric insulation of the hot and electrically charged cutting blade with respect to the metallic base body. It is thereby warranted that the actual base body of the cutting device does not heat up and that the risk of bums is prevented.

A further embodiment in this context suggests that the base body is provided with an actuating grip, whereby a heat insulation is provided in the area between the base body having the heated cutting blade and the actuating grip. This can be accomplished in the case of the metal scissors in that the metal is being removed in this area and is substituted by plastic. A heat conduction into the actuating grip is thereby largely prevented so that additional protective mechanisms in the area of the actuating grip are not needed.

A further preferred embodiment suggests that an electric plug connection is provided at the cutting device for a connecting cable of the electric voltage supply device of the electric current supply of the heating elements. The basic idea is that the connection cable of the electric voltage supply device does not directly lead to the heating element, but instead contact is made by an electric plug connection. The electric plug connection can be effected by a plug/socket. Thus, the electric plug connection is fixedly integrated into the cutting device. The advantage of this is that the connection cable can be exchanged quickly and easily when it breaks without the necessity of, e.g., disassembling the entire scissors, including the heating element.

Preferably, the electric plug connection is provided within the actuating grip. This is a technically simple solution in order to be able to connect the connection cable to the electric plug connection. In the case of heatable scissors, the electric plug connection can be provided, in particular, in the area of one of the finger openings.

Furthermore, it is suggested in another embodiment that the cables leading from the electric plug connection to the electric heating element are provided within the body of the cutting device. This has the advantage that the cables do not interfere. In the case of scissors, the cables are provided in the grip area.

A further embodiment suggests that the cutting device is a scissors with two cutting blades which are rotatable toward each other about a pivoting axis via a pivoting structure having a roller bearing. The advantage of such scissors, provided with a roller bearing, is that the scissors are significantly easier to actuate in comparison to conventional scissors because the roller bearing decreases the frictional resistance. The term "roller bearing" is to be understood as a descriptive term which includes all such bearings which decrease the frictional resistance between two parts that are being moved. In particular, roller bearings include ball bearings, sleeve bearings and needle bearings.

A preferred embodiment of the inventive scissors suggests that the roller bearing is provided with an outer ring and an inner ring which is concentric and rotatable in relation to the outer ring, the outer ring being fixedly connected with one of the cutting blades and the inner ring with the other cutting blade. Thereby, a technically simple option is created to decrease the frictional resistance between the two cutting blades by means of the roller bearing, the roller bearing rings being each associated with one of the two cutting blades. Thereby, the two roller bearing rings are connected to the two cutting blades such that they respectively rotate together. This can be achieved directly by having the corresponding roller bearing ring directly contact the corresponding cutting blade. However, an indirect connection is also conceivable, e.g., by providing intermediate means between the roller bearing ring and the cutting blade associated therewith.

A further embodiment suggests that the pivoting structure is provided by a bolt, penetrating an aligned bore between the two cutting blades, and a nut. This represents the conventional technical realization of a pivoting structure for scissors.

A further development suggests that the roller bearing is arranged at the outer surface of one of the cutting blades, the outer ring being fixedly connected to this outer side of the cutting blade and the inner ring being fixedly connected to the bolt or the nut. The basic idea of this roller bearing arrangement is, thus, that the roller bearing is not being positioned between the two cutting blades but that the roller bearing is associated with one of the cutting blades. The connection of the roller bearing with the other cutting blade is accomplished by the penetrating bolt which is indirectly connected to the other cutting blade.

A development of this embodiment suggests that a head of the bolt or of the nut rests externally at the inner ring. Thereby, the fixed connection is created by means of the bolt or the nut. The bottom side of the head can be slanted such that it only rests against the inner ring, but not against the outer ring.

A further development thereof suggests that the roller bearing is inserted into an exterior recess of the cutting blade by press fit. Because of this press fit, the fixed connection of the outer ring of the roller bearing to one of the cutting blades is created. This press fit is sufficient to securely hold the roller bearing because scissors have a relatively low pivoting force.

A further development suggests that the head covers the recess. Preferably, the head covers the recess in a sealing manner. Thereby, the antifriction bearing is protected from contamination and thus keeps its easy workability.

In an alternative to the earlier described arrangement of the roller bearing, it is finally suggested that a ring consisting of balls or needles is arranged between the two cutting blades concentrically about the pivoting axis. This means that the surfaces of the cutting blades facing each other directly slide on these balls or needles

BRIEF DESCRIPTION OF THE DRAWINGS

Two embodiments of an inventive heatable cutting device in the form of heatable scissors is described in the following with the aid of the drawings. These show:

FIG. 1 a view of a first embodiment of the scissors;

FIG. 2 a cross-sectional view of the cutting blade of the scissors of FIG. 1;

FIG. 3 a slightly modified embodiment of the illustration of FIG. 2;

FIG. 4 a single view of the cutting blade of the scissors of FIG. 1;

FIG. 5 a detailed view of the scissors of FIG. 1 in the area of the grip opening;

FIG. 6 an illustration of a second embodiment of the scissors;

FIG. 7 an exploded view of the scissors of FIG. 6 in the area of the pivoting structure at an enlarged scale;

FIG. 8 a cross-sectional view of the pivoting structure of FIG. 7.

DESCRIPTION OF PREFERRED EMBODIMENTS

The heatable scissors in FIG. 1 is comprised of a base body 1 made of plastic. This base body 1 is provided with an actuating grip 2 with two finger openings 3.

In the front area, the base body 1 is provided in the blade area with a respective separate cutting blade 4 made of ceramic. At the front end, the cutting blade 4 is provided with a conventional cutting edge 5. The separate cutting blade 4 made of ceramic is inserted into a corresponding recess 6 at the plastic base body 1 and is fixedly connected to the recess, e.g., glued, bolted or riveted to it. At the surface of the cutting blade 4 facing the base body 1, the cutting blade 4 is provided lengthwise and at a parallel spacing to the cutting edge 5 with an electric heating element 7, as can especially be seen in FIGS. 2 and 4. This heating element 7 is of a linear design and is, for example, printed onto the cutting blade 4 by screen-printing. In FIG. 2 the thickness of the heating element 7 is illustrated at an oversized scale. In reality, the thickness of the heating element 7 amounts to only 4 micrometers. Thereby, an integrated unit is created between the cutting blade 4 and heating element 7 wherein the heating element 7 is arranged fixedly and permanently as well as in an undetachable manner to the upper surface of the cutting blade 4. Furthermore, a temperature sensor—not illustrated—is provided which can also be attached to the upper surface of the cutting blade 4.

A modified embodiment is illustrated in FIG. 3. Here, the base body 1 is made of metal and is provided with a corresponding recess 6. This can, for example, be achieved by milling conventional metal scissors. Here, an identical cutting blade 4 is also inserted into the recess 6 of the metallic base body 1. The only difference to the embodiment of FIGS. 1 and 2 consists in an insulation 8 being arranged between the cutting blade 4 and the base body 1. This insulation 8 serves partially as a heat insulation (so that the high temperature of the cutting blade 4 is not transferred to the base body 1) and furthermore as an electric insulation.

Cables 9 serve for the electric voltage supply of the heating element 7 (as well as of the temperature sensor). These are connected to the heating element 7, as especially FIG. 4 illustrates. The cables are guided through the base body 1 rearwardly to the actuating grip 2 and end in an electric plug connection 10 which is embodied as an electric socket. For the electric voltage supply (as well as for temperature sensing) an electric connection cable can be guided from the electric supply unit to the scissors and can be electrically connected to the electric plug connection 10.

FIG. 5 illustrates that the actuating grip 2 is embodied separate from the actual base body 1 and is connected by a screw 11. Because of this design, various actuating grips 2 can be employed according to the respective needs. It can further be seen that a stop 12 in the form of an O-ring is arranged between the actual base body 1 and the actuating grip 2. Also, it can be seen from this drawing how the cables 9 are being guided through the actuating grip 2 and arrive at the electric plug connection 10 in the form of a plug socket.

It has earlier been mentioned in connection with FIG. 3 that the base body 1 can be made of metal. In that event, the metal substance has to be removed in the area between the actual base body 1 and the actuating grip 2 leaving a small stay and it has to be substituted by an insulation ring. this insulation ring prevents an excessive heat transfer from the actual base body 1 to the actuating grip 2.

Finally, it can also be taken from FIG. 5 that the interior of the finger opening 3 of the actuating grip 2 is equipped with an exchangeable ring 13.

Not illustrated is a design variation wherein the cutting blade 4 (if it is made of metal) is supplied with electric voltage in order to generate a flow of current in the hair during the hair cutting process, provided that a corresponding counter electrode is being connected to the body of the respective individual. The scalp is excited and stimulated thereby.

The scissors of the second embodiment in FIGS. 6 to 8 (in which the heating element has been omitted for simplification and clarity) is provided in a conventional manner with two cutting blades 21, 21'. At the rear side, the cutting blades are each provided with an actuating grip 22, 22' with finger openings 23, 23'. In the intermediate area between the cutting blades 21, 21' and the actuating grips 22, 22' a pivoting structure 24 is located, by means of which the two cutting blades 21, 21' can be pivoted relative to each other about a pivoting axis A. The pivoting structure 24 is formed by a bore 25 in the two cutting blades 21, 21' through which a bolt 26 is placed. This bolt 26 has a head 27 which is slanted upwardly at its lower surface. At the opposite side of the head 27 of the bolt 26, a nut 28 is positioned. This nut is also provided with a head 29 and is positive-lockingly held within the lower cutting blade 21'.

A roller bearing 30 is additionally assigned to the pivoting structure 24. This bearing is inserted in the recess 31 within the outer surface of the cutting blade 21 by press fit. The roller bearing 30 has an outer ring 33 and an inner ring 34. Between the outer ring 33 and the inner ring 34, balls 35 are being arranged. In its center, the roller bearing 30 is provided with a bore 36 for the bolt 26.

Because of the press fit, the outer ring 33 is fixedly arranged within the recess 31 of the cutting blade 21. Relative to this fixedly arranged outer ring 33, the inner ring 34 is freely rotatable within the recess 31. The head 27 of the bolt 26 rests on the upper surface of the inner ring 34 in a fixed frictional connection. Since the outer area of the lower surface of the head 27 of the bolt 26 is slanted upwardly, it does not contact the upper surface of the outer ring 33 of the roller bearing 30.

If, e.g., the lower cutting blade 21' is rotated about the pivoting axis A, the pivoting movement is transferred to the inner ring 34 of the roller bearing 30 by the nut 28, the bolt 26 as well as its head 27. Thereby, the cutting blade 21' is very easily rotatable relative to the cutting blade 21. The contact pressure between the two cutting blades 21, 21' can be varied by tightening the bolt 26.

The specification incorporates by reference the entire disclosure of German priority documents 296 18 310.5 of Oct. 16, 1996, 296 18 309.1 of Oct. 16, 1996, 296 22 126.0 of Dec. 20, 1996, as well as of International Application PCT/DE97/02345 of Oct. 14, 1997.

The present invention is, of course, in no way restricted to the specific disclosure of the specification and drawings, but also encompasses any modifications within the scope of the appended claims.

What is claimed is:

1. A heatable cutting device comprising:

a plastic base body having a recess on one side thereof;

at least one cutting blade, comprised of metal or ceramic, inserted into and fixedly connected to said recess;

an electric heating element for heating said cutting blade;

said electric heating element fixedly and permanently connected directly to a side of said cutting blade facing said base body;

said electric heating element attached directly to said cutting blade by printing, sintering or gluing;

and electric connection for connecting said cutting device to an electric voltage supply device for operating said electric heating element;

wherein said cutting device is a scissors comprising two of said cutting blades, wherein said two cutting blades are connected to one another by a pivoting structure comprising a roller bearing so as to be rotatable relative to one another about a pivoting axis;

wherein said pivoting structure comprises a screw and aligned bores in said two cutting blades, wherein said screw extends through said aligned bores, wherein said pivoting structure further comprises a nut securing said screw in said aligned bores.

2. A heatable cutting device according to claim 1, wherein said roller bearing has a outer ring a concentric inner ring, and wherein said roller bearing is arranged at an outer side of one of said two cutting blades, wherein said outer ring is fixedly connected to said outer side and wherein said inner ring is fixedly connected to said screw or said nut.

3. A heatable cutting device according to claim 2, wherein said screw and said nut each has a head, and wherein each said head of said screw or said nut is positioned externally at said inner ring.

4. A heatable cutting device comprising:

a plastic base body having a recess on one side thereof;

at least one cutting blade, comprised of metal or ceramic, inserted into and fixedly connected to said recess;

an electric heating element for heating said cutting blade;

said electric heating element fixedly and permanently connected directly to a side of said cutting blade facing said base body;

said electric heating element attached directly to said cutting blade by printing, sintering or gluing;

and electric connection for connecting said cutting device to an electric voltage supply device for operating said electric heating element;

wherein said cutting device is a scissors comprising two of said cuffing blades, wherein said two cutting blades are connected to one another by a pivoting structure comprising a roller bearing so as to be rotatable relative to one another about a pivoting axis;

wherein one of said two cutting blades has an outer recess and wherein said roller bearing is secured by press fit in said outer recess of said one cutting blade.

5. A heatable cutting device according to claim 4, wherein said pivoting structure comprises a screw with a head and a nut with a head, and wherein said head of said screw or said head of said nut covers said outer recess.

6. A heatable cutting device comprising:

a plastic base body having a recess on one side thereof;

at least one cutting blade, comprised of metal or ceramic, inserted into and fixedly connected to said recess;

an electric heating element for heating said cutting blade;

said electric heating element fixedly and permanently connected directly to a side of said cutting blade facing said base body;

said electric heating element attached directly to said cutting blade by printing, sintering or gluing;

and electric connection for connecting said cutting device to an electric voltage supply device for operating said electric heating element;

wherein said electric connection is an electric plug connection for connecting a connection cable of the electric voltage supply device of an electric current supply; and wherein said base body has an actuating grip and wherein said electric plug connection is arranged at said actuating grip.

7. A heatable cutting device according to claim 6, wherein said electric heating element is formed as a line along a cutting edge of said cutting blade.

8. A heatable cutting device according to claim 6, wherein said cutting blade is supplied with an electric voltage.

9. A heatable cutting device according to claim 6, wherein said electric plug connection has cables connecting said electric plug connection to said heating element, wherein said cables extend in said base body.

10. A heatable cutting device according to claim 6, wherein said cutting device is a scissors comprising two of said cutting blades, wherein said two cutting blades are connected to one another by a pivoting structure comprising a roller bearing so as to be rotatable relative to one another about a pivoting axis.

11. A heatable cutting device according to claim 6, wherein said cutting device is a scissors comprising two cutting blades, said two cutting blades connected to one another by a pivoting structure comprising a ring so as to be rotatable relative to one another about a pivoting axis, said ring consisting of balls or needles, and concentrically arranged about said pivoting axis between said two cutting blades.

12. A heatable cutting device according to claim 6, wherein said electric heating element is attached directly to said at least one cutting blade by printing a current-conducting paste onto said at least one cutting blade and subsequent firing of said current-conducting paste.

* * * * *